US005211260A

United States Patent [19]

Toycen

[11] Patent Number: 5,211,260

[45] Date of Patent: May 18, 1993

[54] COLLAPSIBLE LADDER

[76] Inventor: Jeffrey E. Toycen, 33 Sandhurst Court, Ottawa, Ontario, Canada, K1V 9W9

[21] Appl. No.: 888,823

[22] Filed: May 27, 1992

[30] Foreign Application Priority Data

Nov. 15, 1991 [CA] Canada ..... 2055677

[51] Int. Cl.[5] ..... E06C 1/52

[52] U.S. Cl. ..... 182/164

[58] Field of Search ..... 182/164, 163, 198, 206, 182/152, 156, 214

[56] References Cited

U.S. PATENT DOCUMENTS

| | | | |
|---|---|---|---|
| 295,477 | 3/1884 | Bessier | 182/163 X |
| 3,004,624 | 10/1961 | Green | 182/157 |
| 4,067,413 | 1/1978 | Olsen | 182/164 |
| 4,231,449 | 11/1980 | Laurita | 182/164 |
| 4,260,039 | 4/1981 | Arato et al. | 182/164 |
| 4,751,982 | 6/1988 | Wolfe | 182/164 |

FOREIGN PATENT DOCUMENTS 1111394 10/1981 Canada .

OTHER PUBLICATIONS

Canadian Industrial Design No. 53,339, M. Rosenstraus & T. Stacenko, Feb. 1984.

*Primary Examiner*—Alvin C. Chin-Shue
*Attorney, Agent, or Firm*—Ronald G. Bitner

[57] ABSTRACT

A collapsible ladder that is relatively rigid and includes friction means for controlling the rate of deployment. The ladder comprises a plurality of tubular rungs and side support members pivotally connected between each end of adjacent rungs, each side support member comprising a pair of pivotally interconnected tubular links each having a length less than half of that of the rungs. The links have ends with flat surfaces defining a contacting region for contacting the flat surface of an adjacent pivotally interconnected link. Included are pivotal connecting means comprising a first pivot pin disposed in apertures provided in each adjacent pair of links which define a side support member, and a second pivot pin disposed in apertures provided in each end of each rung and the aperture of at least one side support member, the apertures and pivot pins being disposed inwards from the ends of the links to define support arms outside of the pin, the support arms having bearing surfaces that bear on the adjacent link for providing rigidity of the pivotally interconnected links, about an axis passing transversely through the pivot pin and parallel with the rungs, when the ladder in a deployed condition; and a tension applying fastener associated with at least some of the pins for drawing the contacting regions of the links against one another with a force sufficient to provide a frictional force upon pivoting of the links for restricting the deployment rate of the ladder.

11 Claims, 1 Drawing Sheet

COLLAPSIBLE LADDER

FIELD OF THE INVENTION

This invention relates to a collapsible ladder, and particularly to a ladder which is collapsible for storage or transport, and extendable for use.

BACKGROUND OF THE INVENTION

Various type of collapsible ladders are known. One commonly known type known as a rope ladder comprises a pair of ropes that are attached to a series of rungs. U.S. Pat. No. 4,260,039 discloses a collapsible ladder that comprises a plurality of rungs and side support members comprising two generally rigid sections pivotally connected together. While such a ladder is more rigid than a rope ladder, the rigidity is less than desirable, particulary when used over regions lacking the support of a wall, such as at windows.

U.S. Pat. No. 4,231,449 discloses a foldable ladder that purports to provide rigidity. However, the construction is relative complex and appears to be expensive to manufacture.

The known collapsible ladders are not provided with means for controlling the rate of deployment which becomes a problem as the length and mass of the ladder increases.

SUMMARY OF THE INVENTION

An object of the present invention is to provide a collapsible ladder of simple construction that is relatively rigid.

Another object of a specific embodiment of the present invention is to provide a collapsible ladder in which the deployment rate can be controlled.

It has been found that a relatively rigid ladder can be made at low cost utilizing simple tubular material constructed and joined in a specific manner such that extensions of pivotally interconnected links form support arms that operate to resist deformation at the pivotal joint in the deployed condition. It was further found that frictional forces can be readily provided in the pivotal joint to allow control of the deployment rate of the ladder.

In accordance with the present invention there is provided a collapsible ladder comprising: a plurality of tubular rungs; side support members pivotally connected between each end of adjacent rungs, each side support member comprising a pair of pivotally interconnected tubular links each having a length less than half of that of the rungs; said links having ends with flat surfaces defining a contacting region for contacting the flat surface of an adjacent pivotally interconnected link; pin receiving apertures passing through opposite wall portions of the tubular rungs and the tubular links near the ends thereof; pivotal connecting means comprising a first pivot pin disposed in the aperture of each adjacent pair of the interconnected links that define said support member, and a second pivot pin disposed in the aperture of each end of each of the rungs and the aperture of at least one of said side support members; said apertures and pivot pins being disposed inwards from the ends of the links to define support arms outside of the pin, said support arms having bearing surfaces that bear on the adjacent link for providing rigidity of the pivotally interconnected links, about an axis passing transversely through said pivot pin and parallel with the rungs, when the ladder in a deployed condition; and compression applying fastener means associated with at least some of said pins for pressing the contacting regions of the links against one another with a force sufficient to provide a frictional force upon pivoting of said links for restricting the deployment rate of the ladder.

DESCRIPTION OF THE PREFERRED EMBODIMENTS

Figure 1:
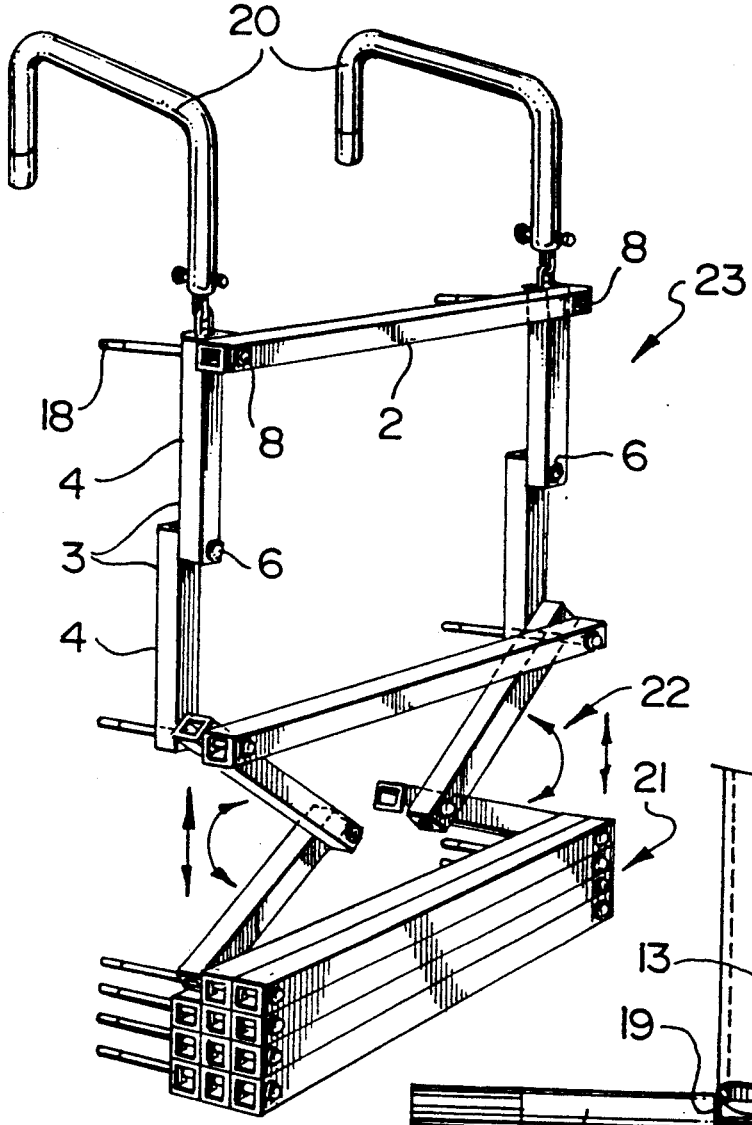
FIG. 1 is a perspective view of the collapsible ladder of the present invention showing a portion of the ladder in the collapsed condition, a portion in the collapsing pivoting condition, and a portion in the extended condition.
Figure 2:
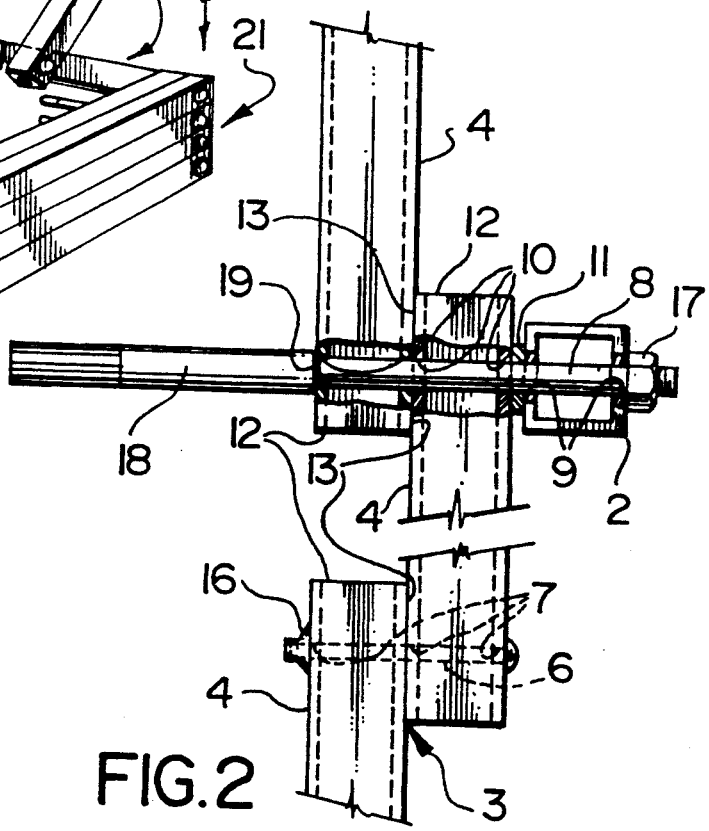
FIG. 2 is an enlarged view of a portion of the ladder as shown in FIG. 1, showing details of the pivotal connecting means.

With reference to FIGS. 1 and 2, the collapsible ladder 1 of the present invention comprises a plurality of tubular rungs 2 and side support members 3.

The side support members 3 comprise a pair of pivotally interconnected tubular links 4, the length of which is less than half of the length of the rungs 2. The links have ends with flat surfaces defining a contacting region for contacting the flat surface of an adjacent pivotally interconnected link.

Pin receiving apertures 7, 9 and 10 are provided in the opposite wall portions of the tubular rung 2 and the tubular links 4, near the ends thereof.

The links 4 and rungs 2 are interconnected by pivotal connecting means comprising a first pivot 6 pin disposed in the apertures 7 of each adjacent pair of links which define a side support member 3, and a second pivot pin 8 disposed in the aperture 9 of each end rung 2 and the aperture 10 of at least one side support member 3.

A spacer 11 disposed between rung 2 and adjacent link 4 provides clearance for the projecting head portion of the pin 6 that pivotally interconnects the adjacent links 4. As will be described hereinafter, the spacer 11 may be made of material that provides frictional forces with the surfaces of the link 4 and rung 2 that it contacts for the purpose of controlling deployment rate.

It can be seen that the use of tubular rungs and links provides a pair of spaced apart walls both of which make supporting contact at the apertures with the pin providing rigidity by virtue of the relatively long distance between the opposite supporting points, while at the same time allowing relatively low weight of the links and rungs, and hence the ladder as a whole.

The tubular rungs and links will preferably have a square, or nearly square, cross-section for economics and simplicity in providing the desired flat contacting surfaces, as described herein. A ladder found to be suitable had rungs and links made of $\frac{3}{4}$ inch tubing having a wall thickness of $\frac{1}{8}$ inch.

The apertures and pivot pins are disposed inwards from the ends of the links to define support arms 12 outside of the pins 6 and 8. The support arms 12 have bearing surfaces 13 that bear on the adjacent link for providing rigidity of the pivotally interconnected links, about an axis passing transversely through one pivot pin and parallel with the rungs, when the ladder is in a deployed condition. Such rigidity allows the deployed ladder to span open areas of the building, such as over windows, without bending inward toward the building as the user descends.

To provide acceptable rigidity of the length of the support arms 12 will preferably be at least 6% of the length of the link, and preferably in the range of 6 to 10% of the length of the link.

With longer ladders, in particular, it is desirable that rate of deployment be limited or controlled in order to reduce the likelihood of injury or damage from the falling mass. The deployment rate of the ladder can be controlled by providing frictional forces between adjacent contacting surfaces of at least some of the pivotal interconnections. Frictional force is increased by increasing the force with which the pivoting contacting members are drawn together by means of the fasteners 16 and 17 on pins 6 and 8, respectively.

The magnitude of frictional force obtained upon pivoting of the links will be dependent on the area of the contacting surface of the links 4, the compressive force applied by the fasteners 16 and 17 on pins 6 and 8, respectively, and the coefficient of friction of the adjacent surfaces. With a ladder constructed of square cross-section aluminum tubing, it was found that suitable areas for the contacting surface of the links is from 20 to 35%, and preferably in the range of 25 to 35%, of the surface area of one side of the link.

The fastener 16, associated with pin 6, comprises a cap nut having an outer resilient component that resiliently engages the surface of link 4. Pin 8 is shown fastened with a locking threaded fastener 17. The fasteners 16 and 17 are applied with sufficient force to provide the pivotal frictional force required for the desired rate of deployment. It will be appreciated that various different types of fasteners could be used.

To obtain significant frictional force, the amount of compressive force applied by means of the fastener 16 and/or 17, pressing contacting surfaces against one another, should be at least 0.05 pounds per square inch. For longer ladders the frictional force will preferably be higher for upper portions of the ladder relative to lower portions. The variation in frictional force can be conveniently obtained by varying the compressive force applied by the fasteners 16 and/or 17.

For certain applications it may be desirable to provide adjustability of the frictional force. For example, it may be desirable to use relatively high frictional force for a ladder that will be used from a helicopter. Adjustability can be conveniently achieved with the use of a locking threaded fastener, such as fastener 17 shown in FIG. 2.

To provide additional frictional force the spacer 11 may include surfaces made of material that provides large frictional forces with the surfaces of the links 4 and rung 2 that it contacts. A material found particularly suitable for the spacer was a compressible material such as neoprene. The use of a compressible material for the spacer facilitates assembly since it simplifies the procedure for obtaining the desired force with which the members are drawn together and retained by means of the fastener 17 on pin 8.

It can be seen that frictional force can also be obtained by choosing a pivot pin size relative to aperture size that provides interference.

The pivot pins 8 are shown to extend rearward forming standoffs 18 which provide that the ladder is spaced from the building to facilitate use. The pins 8 are shown to have a portion of reduced diameter to form a shoulder 19 which abuts against and retains the link 4 on the side opposite to the fastener 17.

FIG. 1 shows the ladder provided with hooks 20 for support over a window sill, or the like, for use.

FIG. 1 shows a portion of the ladder 21 in the collapsed condition, and a portion 22 in the process of deployment with links 4 pivoted in an intermediate position. Portion 22 illustrates the fully extended or deployed condition.

What is claimed is:

1. A collapsible ladder comprising:

a plurality of tubular rungs;

side support members pivotally connected between each end of adjacent rungs, each side support member comprising a pair of pivotally interconnected tubular links each having a length less than half of that of the rungs;

said links having a generally square cross-section for providing ends with flat surfaces defining a contacting region for contacting the flat surface of an adjacent pivotally interconnected link, and wherein the area of the contacting region of the links is from 20 to 35% of the surface area of one side of the link;

pin receiving apertures passing through opposite wall portions of the tubular rungs and the tubular links near the ends thereof;

pivotal connecting means comprising a first pivot pin disposed in the aperture of each adjacent pair of the interconnected links that define said support member, and a second pivot pin disposed in the aperture of each end of each of the rungs and the aperture of at least one of said side support members;

said apertures and pivot pins being disposed inwards from the ends of the links to define support arms outward from the pin, said support arms having bearing surfaces that bear on the adjacent link for providing rigidity of the pivotally interconnected links, about an axis passing transversely through the pivot pin and parallel with the rungs, when the ladder is in an deployed condition; and compression applying fastener means associated with at least some of said pins for pressing the contacting regions of the links against one another with a force sufficient to provide a frictional force upon pivoting of said links for restricting the deployment rate of the ladder, and the compression force applied by the fastener is greater than 0.05 pounds per square inch.

2. The ladder of claim 1 wherein the compression force applied by the fastener and the length of the support arm are selected to provide pivotal frictional force of magnitude sufficient to provide the desired rate of deployment of the ladder.

3. The ladder of claim 1 further comprising a compressible washer disposed about said second pivot pin between the rung and adjacent link for providing friction upon pivoting for restricting the deployment rate of the ladder.

4. The ladder of claim 1 wherein the tubular rungs and links have a substantially square cross-section.

5. The ladder of claim 1 wherein the area of the contacting region of the links is from 25 to 30% of the surface area of one side of the link.

6. The ladder of claim 1 wherein the length of the support arm is 6 to 10% of the length of the link.

7. The ladder of claim 1 wherein the compression force applied by the fastener is greater than 0.1 pounds per square inch.

8. The ladder of claim 1 wherein the compression force applied by the fastener is higher for upper portions of the ladder relative to lower portions of the ladder.

9. The ladder of claim 8 wherein the compression force applied by the fastener is 0.01 pounds per square inch times the distance from the bottom of the ladder in feet.

10. The ladder of claim 1 wherein the compression applying fastener comprises a resilient element.

11. The ladder of claim 1 wherein at least some of the second pivot pins extend rearward to define a standoff for the ladder.

* * * * *